United States Patent [19]

Plazter

[11] Patent Number: 4,578,156

[45] Date of Patent: Mar. 25, 1986

[54] ELECTROLYTES FOR ELECTROCHEMICALLY TREATING METAL PLATES

[75] Inventor: Stephan J. W. Plazter, Califon, N.J.

[73] Assignee: American Hoechst Corporation, Somerville, N.J.

[21] Appl. No.: 680,029

[22] Filed: Dec. 10, 1984

[51] Int. Cl.[4] ..... C25D 5/44

[52] U.S. Cl. ..... 204/33; 204/32.1; 204/34; 204/38.3; 204/56 R; 204/56 M; 101/454; 101/456; 101/459

[58] Field of Search ..... 204/32.1, 33–34, 204/38 A, 56 R, 56 M, 58, 37.6; 101/459, 454, 456

[56] References Cited

PUBLICATIONS

"The Surface Treatment of Al & Its Alloys", by S. Wernick et al., 3rd Ed., 1964, pp. 348, 365.

*Primary Examiner*—R. L. Andrews

*Attorney, Agent, or Firm*—Richard S. Roberts

[57] ABSTRACT

The invention provides an electrochemical process for applying a firmly bonded substantially insoluble metal oxide-organic complex on a metal surface by employing the metal as anode and a water-soluble polybasic organic acid plus a base as electrolyte. The polybasic acid may be a polyphosphonic acid, polyphosphoric and polycarboxyl acid, or polysulfonic acid and is advantageously polymeric. Polyvinyl phosphonic acid (PVPA) is a preferred electrolyte. Direct current is used. The insoluble metal oxide-organic complex formed is composed of anodic oxide combined with polyacid, which forms a protective layer on the metal of improved corrosion resistance. The metal oxide-organic complex is well-suited to bond light sensitive coatings thereto. The metal may be steel, aluminum or magnesium. The process is economical and the product novel. Sufficient base is added to give the electrolyte a pH in the range of from about 3 to about 10.

39 Claims, No Drawings

ELECTROLYTES FOR ELECTROCHEMICALLY TREATING METAL PLATES

BACKGROUND OF THE INVENTION

This invention relates to treating the surface of metal sheets with electrolytes and the products thereby obtained. The resulting metal sheets have improved corrosion resistance and are suitable, among other uses, for lithographic applications. When used as supports in lithography, particularly if aluminum or its alloys are selected, such sheets exhibit improved adhesion for light sensitive coatings, improved printing plate run length, lessened wear by a press both in image and non-image areas, greater shelf life, and improved hydrophilicity in non-image areas.

Anodization is an electrolytic process in which the metal workpiece is made the anode in a suitable electolyte. When electric current is passed, from a cathode through the electrolyte to the metal workpiece, the surface of the metal is converted to a form of its oxide having decorative, protective or other properties. The cathode is either a metal or graphite, at which the only important reaction is hydrogen evolution. This coating progresses from the solution side, outward from the metal, so the last-formed oxide is adjacent to the metal. The oxygen required originates from the electrolyte used.

Anodic oxide coatings on aluminum may be of two main types. One is the so-called barrier layer which forms when the anodizing electrolyte has little capacity for dissolving the oxide. These coatings are essentially nonporous; their thickness is limited to about 13 Å/volt applied. Once this limiting thickness is reached, it is an effective barrier to further ionic or electron flow. The current drops to a low leakage value and oxide formation stops. Boric acid and tartaric acid are used as electrolytes for this process.

When the electrolyte has appreciable solvent action on the oxide, the barrier layer does not reach its limiting thickness: current continues to flow, resulting in a "porous" oxide structure. Porous coatings may be quite thick: up to several tens of micrometers, but a thin barrier oxide layer always remains at the metal-oxide interface.

Electron microscopic studies show the presence of small, close-packed cells of amorphous oxide throughout the oxide layer, generally peroendicular to the metal-oxide interface.

Sulfuric acid is the most widely used electrolyte, with phosphoric also popular. Anodic films of aluminum oxide are harder than air-oxidized surface layers.

Anodizing for decorative, protective and adhesive bonding properties has used strong electrolytes such as sulfuric acid and phosphoric acid. U.S. Pat. No. 2,703,781 employs a mixture of these two electrolytes.

U.S. Pat. No. 3,227,639 uses a mixture of sulfophthalic and sulfuric acids to produce protective and decorative anodic coatings on aluminum. Other aromatic sulfonic acids are used with sulfuric acid in U.S. Pat. No. 3,804,731.

As a post-treatment after anodization, the porous surface is sealed according to numerous processes to determine the final properties of the coating. Pure water at high temperature may be used. It is believed that some oxide is dissolved and reprecipitated as a voluminous hydroxide (or hydrated oxide) inside the pores.

Other aqueous sealants contain metal salts whose oxides may be coprecipitated with the aluminum oxide.

U.S. Pat. No. 3,900,370 employs a sealant composition of calcium ions, a water-soluble phosphonic acid which complexes with a divalent metal to protect anodized aluminum or anodized aluminum alloys against corrosion. Polyacrylamide has been proposed as a sealant.

U.S. Pat. No. 3,915,811 adds an organic acid (acetic acid, hydroxy acetic acid, or amino acetic acid) to a mixture of sulfuric and phosphoric acids to form the electrolyte in preparation for electroplating the so-formed anodic aluminum coating.

U.S. Pat. No. 4,115,211 anodizes aluminum by A.C. or superimposed A.C. and D.C. wherein the electrolyte solution contains a water-soluble acid and a water-soluble salt of a heavy metal. The water-soluble acid may be oxalic, tartaric, citric, malonic, sulfuric, phosphoric, sulfamic or boric.

U.S. Pat. No. 3,988,217 employs an electrolyte containing quaternary ammonium salts, or aliphatic amines and a water-soluble thermosetting resin to anodize aluminum for protective, ornamental or corrosion resistant applications.

The advantages of anodized aluminum as a carrier for lithographic printing plates were early recognized. Processes employing as electrolytes sulfuric acid, phosphoric acid, mixtures of these, or either of these in succession have been proposed. Prior to anodizing the sheet may be roughened mechanically, electrochemically or chemically. The need for a subcoating prior to the application of a photosensitive layer was recognized to impart adhesion to the coating and hydrophilicity to the non-image areas. U.S. Pat. No. 3,181,461 uses an aqueous alkaline silicate treatment following the anodization step.

U.S. Pat. No. 2,594,289 teaches (Col. 1, lines 42–54) that porous anodic films but not nonporous anodic films are suitable for lithographic purposes, "since the porous film confers a better water receptive surface to the non-image areas of the plate and allows image-forming material to anchor effectively to the surface by penetrating the pores."

U.S. Pat. No. 3,511,661, since disclaimed, describes aluminum sheet for a lithographic printing surface anodized in aqueous phosphoric acid having an anodic film with a cellular pattern of aluminum oxide having cells with porous openings of about 200 Å to 700 Å in average diameter and a surface with 10 to 200 mg per square meter of aluminum phosphate.

U.S. Pat. No. 3,658,662 describes the electrochemical silication of a cleaned, etched aluminum plate to achieve a measure of hydrophilization.

In U.S. Pat. No. 3,902,976 a conventionally anodized aluminum sheet is electrolytically post-treated in an aqueous solution of sodium silicate to form a hydrophilic abrasion-resistant and corrosion-resistant layer suitable as a support for a presensitized lithographic sheet.

U.S. Pat. No. 4,022,670 carries out anodization of aluminum sheets in an aqueous solution of a mixture of polybasic mineral acid such as sulfuric and a higher concentration of a polybasic aromatic sulfonic acid such as sulfophthalic acid to produce a porous anodic oxide surface to which a photosensitive layer may be directly applied.

There is described in U.S. Pat. No. 4,090,880, a two-step process whereby a cleaned aluminum sheet is first coated with an interlayer material such as alkali silicate. Group IV-B metal fluorides, polyacrylic acid, or alkali zirconium fluoride and then anodized conventionally in aqueous sulfuric acid. Enhanced shelf life when overcoated with diazo sensitizers is claimed.

U.S. Pat. No. 4,153,461 employs a post-treatment with aqueous polyvinyl phosphonic acid at temperatures from 40° to 95° C. after conventional anodizing to a thickness of at least 0.2 um. The treatment provides good adhesion of a subsequently applied light sensitive layer, good shelf life and good hydrophilization of non-image areas after exposure and development as well as long press runs.

U.S. Pat. Nos. 4,383,897; 4,399,021; 4,448,647; and 4,452,674 which are incorporated herein by reference also teach related electrolysis techniques.

Plates of the above construction, particularly when the light sensitive layer is a diazo compound have enjoyed considerable commercial success. Nevertheless, certain improvements would be desirable. These include freedom from occasional coating voids, occasional unpredictible premature image failure on the press, faster, more dependable roll-up on the press and freedom from other inconsistencies. Still greater press life is desirable as well as a process that would be more economical than conventional anodizing followed by a second operation of sealing or post-treating in preparation for coating with a light sensitive layer.

In the case of protective and decorative applications, improved corrosion resistance and production economy over known anodizing processes is desired.

SUMMARY OF THE INVENTION

According to the invention there is provided an electrochemical process for applying a firmly bonded insoluble metal oxide-organic complex on a metal surface by employing the metal as anode and a water-soluble polybasic organic acid composition as electrolyte wherein the electrolyte contains a sufficient amount of a compatible base to provide the electrolyte with a pH in the range of from about 3 to about 10. The polybasic acid may be a polyphosphonic acid, polyphosphoric and polycarboxyl acid, or polysulfonic acid and is advantageously polymeric. Polyvinyl phosphonic acid PVPA is a preferred electrolyte. Direct current is used. The insoluble metal-organic complex formed is composed of anodic oxide combined with polyacid, which forms a protective layer on the metal of improved corrosion resistance. The metal oxide-organic complex is well-suited to bond light sensitive coatings thereto. When used as a lithographic support the shelf life, lithographic properties and press life are improved over the products of previous processes.

Formally, the invention provides a process for preparing an element comprising cleaning a metal article, and then anodizing said metal article using direct current in an aqueous organic electrolytic solution having dissolved therein a water-soluble organic acid or mixture of two or more water-soluble organic acids which, if carboxylic be at least tribasic, and a sufficient amount of a base to give said solution a pH in the range of from about 3 to about 10; under electrolytic conditions sufficient to form an insoluble metal oxide-organic complex, including said organic acid, bonded to the surface of said metal article. An analysis of the surface of the product of the invention shows it is substantially non-porous.

DETAILED DESCRIPTION OF PREFERRED EMBODIMENT

The metal substrates to be subjected to electrochemical treatment according to the invention are first cleaned. Cleaning may be accomplished by a wide range of solvent or aqueous alkaline treatments appropriate to the metal and to the final end-purpose.

Typical alkaline degreasing treatments include: hot aqueous solutions containing alkalis such as sodium hydroxide, potassium hydroxide, trisodium phosphate, sodium silicate, aqueous alkaline and surface active agents. A proprietary composition of this type is Ridolene 57, manufactured by Amchem Products, Pennsylvania. Currently less popular because of environmental and health considerations, is solvent degreasing, using trichloroethylene, 1,1,1-strichloroethane, and perchloroethylene. Solvent degreasing is accomplished by immersion, spray or vapor washing. Included among suitable metals are steel, magnesium, or aluminum or its alloys. Aluminum alloys 1100, 1050, 3003 and A-19, available from Alcoa, and the Consolidated Aluminum Company among others, may be used as the lithographic substrates. Typical analyses of lithographic alloys are shown on a weight percent basis:

| Alloy | Al | Mg | Mn | Fe | Si | Cu |
|---|---|---|---|---|---|---|
| 1100 | 99.2 | — | — | .375 | .375 | .05 |
| 3003 | 99.0 | — | .7 | .15 | .2 | .05 |
| A-19 | 99.3 | .9 | — | .375 | .375 | .05 |

It is surmised that the specific chemical composition of the alloy may have an influence upon the effectiveness of electrodeposition of organic electrolytes. Further other components not usually analyzed may also have an influence.

The metal surface may be smooth or roughened. Conventional surface roughening techniques may be employed. They include but are not restricted to chemical etching in alkaline or acid solutions, graining by dry abrasion with metal brushes, wet abrasion with brushes and slurries of abrasive particles, ball graining and electrochemical graining. All of these processes are well known in the art. The surface roughness and topography varies with each of these processes. For best results according to the practice of this invention, the clean surface should be immediately electrotreated before the formation of an aerial oxide. Prior to immersion of a previously cleaned, degreased and optionally roughened plate in the organic electrolyte solution for electrodeposition, the plate should be etched to remove aerial oxide. Such etching can be accomplished by known etching means including acid and alkaline and electrolytic treatments with the above followed by rinsing. A method for removal of aerial oxide is stripping the plate with an etchant such as a phosphoric acid/chromic acid solution. Thus immediately after cleaning and roughening (if this step is desired) and etching it is preferable that the metal surface should be rinsed with water and electrotreated while still wet, although useful products may be obtained if this precaution is not rigidly adhered to.

After cleaning and after roughening, if desired, the metal may be optionally anodized conventionally prior to electrodeposition of the organic electrolyte of this invention.

Organic electrolytes which are suitable for improvement of corrosion resistance according to this invention include aqueous solutions of sulfonic acids, phosphonic acids, phosphoric acids and carboxylic acids which are at least tribasic, both monomeric and polymeric and mixtures of the above. Specific electrolytes include nitrilo triacetic acid 1,2,4,5-benzene tetracarboxylic acid, condensation product of benzene phosphonic acid and formaldehyde (polybenzene phosphonic acid), copolymers of methylvinyl ether and maleic anhydride at various molecular weights, copolymer of methylvinyl ether and maleic acid, polyvinyl sulfonic acid, polystyrene sulfonic acid, phytic acid, alginic acid, poly-n-butyl benzene sulfonic acid, poly diisopropyl benzene sulfonic acid, polyvinyl phosphonic acid, dodecyl-polyoxy ethylene phosphoric acid, tridecyl benzene sulfonic acid, dinonyl naphthalene disulfonic acid-2,2'-dinitro, 4,4'-stilbene disulfonic acid, diisopropyl polynaphthalene disulfonic acid, 2-ethylhexyl polyphosphoric acid, dodecyl naphthalene disulfonic acid, di-n-butyl naphthalene disulfonic acid, polydecyl benzene sulfonic acid, polyacrylic acid, polymethacrylic acid, diethylene diamine pentaacetic acid, polynaphthalene sulfonic acid, ethylenediamine tetraacetic acid, hydroxyethyl ethylenediamine triacetic acid, and mixtures of any of the foregoing. All of the above are water-soluble.

For lithographic applications, a high degree of hydrophilicity and firm adhesion of the image is necessary. Preferable electrolytes include the condensation product of benzene phosphonic acid and formaldehyde, lower molecular weight copolymers of methylvinyl ether and maleic anhydride, copolymers of methylvinyl ether and maleic acid, polyvinyl sulfonic acid, phytic acid, polyvinyl phosphonic acid, dodecyl polyoxy ethylene phosphoric acid, diisopropyl polynaphthalene sulfonic acid, 2-ethylhexyl polyphosphoric acid, ethylenediamine tetra acetic acid hydroxy ethylethylene diamine triacetic acid and mixtures of any of the foregoing.

Most preferred, particularly for lithographic applications include the condensation product of benzene phosphonic acid and formaldehyde, phytic acid, polyvinyl phosphonic acid, 2-ethylhexyl polyphosphoric acid and mixtures of any of the foregoing.

Phytic acid mixed with polyvinyl phosphonic acid, for example. provides a very suitable electrolyte mixture.

The concentration of the electrolyte, the electrolysis conditions used, e.g. voltage, current density, time, temperature all play roles in determining the properties of the coated metal.

The specific combination of these parameters may be determined by the skilled artisan depending upon the exact surface configuration desired for his intended purpose. The electrolytic solution employed according to the present invention incorporates a sufficient amount of a compatible base to provide the solution with a pH in the range of from about 3 to about 10. A more preferred range is from about 4 to about 8 and a most preferred embodiment ranges from about 6 to about 7. Very high and very low pH's cause an undesired dissolution of the anodic layer. It has been found that the closer to neutrality the pH is, the better is the bond between the acid component and the metal sheet workpiece. In addition, the workpiece need not be rinsed after the anodizing treatment. As the metallic bond is enhanced, there is an improved incorporation of the acid component in the anodic layer. This result manifests itself in an increased length of run to a lithographic printing plate produced with a substrate thusly prepared. Non-limiting examples of suitable bases useful in the context of the present invention include hydroxides such as sodium, lithium, potassium and ammonium hydroxide. It is believed that a harder anodic layer is formed in the indicated pH range due to the decrease in aluminum oxide solubility.

The bonding of an electrolytically deposited film is much greater than when prior art thermal immersion is used after anodizing. A 1.0N NaOH solution removes most of such thermally deposited coating but virtually none of an electrolytically deposited film which is therefore insoluble in reagents of equal or lower aggressiveness.

For lithographic applications, plates are tested after electrodeposition of the metal oxide-organic complex and before coating with a light sensitive layer. The plate is wet or dry inked; the latter test being more severe. After inking, the plate is rinsed under running water or sprayed ith water and lightly rubbed. The ease and completeness of ink removal indicates the hydrophilicity of the surface.

Typically, plates prepared in accordance with the invention, when dry inked and baked in an oven at 100° C., rinse totally free of ink. By contrast, plates either unanodized or conventionally anodized and then subjected to a thermal immersion in an aqueous solution of polyvinyl phosphonic acid are irreversibly scummed when aged even under less severe conditions.

Using the inking tests, plates both with and without photosensitive coatings are aged at various times and temperatures and checked for retention of hydrophilic properties. Plates coated with various diazo coatings were checked with aging for stepwedge consistency, resolution, retention of background hydrophilicity, and ease of development. Suitable light sensitive materials will be discussed below.

Finally, for lithographic applications, plates including controls, are run on press. Differences in topwear, dot sharpening, stepwedge rollback, speed and cleanliness of roll-up, and length of run are observed. In general, in all cases, plates electrodeposited within an extensive range of concentration, time, temperature, voltage, and current density are superior to prior art plates with little criticality in the variables being shown. However, within the confines of the invention, certain variables proved more important than others and certain parameters of those variables were more critical in obtaining best results. This is discussed in more detail below.

The succession of events with increased time in a typical electrodeposition trial may be described. For example, polyvinyl phosphonic acid at 1.5% concentration titrated to pH=6 with sodium hydroxide is used as a electrolyte at a temperature of 23° C. at 60 volts D.C. with a cleaned and etched grade 1050 aluminum plate as the anode and a carbon rod as the counter electrode.

The aluminum oxide-organic complex which comprises the surface film forms very rapidly at first. After 1 sec of electrodeposition, the film is over 0.12 um thick. After 3 sec, the thickness is up to 0.17 um and in 5 sec it is starting to level off to a value of 0.20 um. There is no appreciable increase in the layer thickness even after 120 sec.

The voltage is held substantially constant throughout the electrodeposition period.

The amperage is not a prime variable but is set by the other conditions selected, particularly the voltage and electrolyte concentration. The amperage begins to decline very shortly after the beginning of electrolysis.

The picture is that of a self-limiting process, in which an electrodeposited barrier layer is formed composed of a metal oxide-organic complex, which restricts the further flow of current. The restriction is not as severe as in the case of boric acid anodization, in which the maximum film thickness is 13–16 Å/volt as found by typical surface analytical technique (i.e., Auger analysis) coupled with ion sputtering.

It is believed, based upon experiments at various voltages and times, that the metal oxide-organic complex film upon the metal surface acts as a capacitor. As long as the dielectric strength is not exceeded during electrolysis, there is no further weight gain with time and the film is unbroken. When the dielectric strength is exceeded, perforation of the film takes place with loss of film integrity. Although the picture is believed to represent the situation, it is only a speculation and the validity of the invention does not rest upon it. The aforementioned breakdown is primarily a function of voltage with 70 volts the lowest potential at which breakdown takes place quickly. However, even at 30 volts, provided the time is prolonged beyond 250 seconds, some breakdown is observed.

The boundary of breakdown conditions will therefore depend upon the process variables selected. Within this boundary, readily tested by procedures disclosed, there lies the most preferred conditions for the performance of the inventive process and the obtaining of the corresponding products. However, it should be remembered that within a much wider range of conditions which are comparatively non-critical, there are obtained products all of which are improvements over the prior art.

The concentration of electrolyte that may be used ranges from about 0.01% to saturation and does not depend greatly upon its chemical structure. Solutions above about 30% are impractical at the lower concentration end, solution conductivity is very low, e.g. 61,000 in the case of polyvinyl phosphonic acid at 0.001%. Nevertheless, even at a concentration of 0.05%, a metal oxide-organic complex film is formed which confers properties of corrosion resistance, aging resistance, hydrophilicity and lithographic properties superior to typical products of the prior art such as an aluminum plate conventionally anodized and then thermally sealed in a solution of polyvinyl phosphonic acid as a second step.

Current carrying capacity increases rapidly with concentration, resulting in shorter process times and lower voltage requirements.

There appears to be little difference in the properties of products between 1% and 5% while characteristic properties are still obtained at 30%, despite the high viscosity of the electolyte. Furthermore, there is a decline in the rate of film formation at constant voltage with increase in concentration. Based upon considerations of properties obtained, processing ease, film thickness obtained, and cost of electrolyte, a preferred concentration range lies between about 0.8% and about 5%.

There is a reasonably linear relationship between the weight per unit area of insoluble metal oxide-organic complex film formed and the direct current voltage employed. At all voltages over about 5 volts, the electrodeposited film that is formed confers corrosion resistance and lithographic properties superior to prior art.

As the voltage is raised to 70 volts (DC), a result believed to be due to the loss in film integrity as the dielectric strength of the film is exceeded and it becomes perforated. Corrosion resistance is thus favored by operation under 70 volts. Direct current is required for the process, although alternating current may be superimposed. Pulsed direct current may also be used. Square waves from pulse plating sources are particularly useful.

Amperage with fixed voltage is at a maximum at the beginning of electrodeposition and declines with time as the metal oxide-organic complex film builds upon the metal surface and reduces current carrying capacity. Within 30 seconds it has declined to a level at which further current consumption becomes minimal. This is a major factor in processing economy, as a useful, desirable film has already been deposited.

With the 1.5% solution of polyvinyl phosphonic acid and sodium hydroxide at pH=6, the amperage surged to about 10 amps/dm$^2$ and then declined to about 0.1 amps/dm$^2$ after 5 sec. This decline to very low current levels is characteristic of the process using the organic electrolytes of this invention. By contrast, in normal anodizing using strong electrolytes above, the current drops slowly and remains at levels around 10 to 15 amperes for the balance of the process.

Amperage is thus a dependent variable, with electrolyte identity, concentration and voltage the independent variables. Current densities of from about 1 amp/dm$^2$ to about 5 amps/dm$^2$ are characteristic of favorable process operating conditions and are preferred.

The temperature at which the process is conducted may range from about −2° C. (near the freezing point of the electrolyte) to about 60° C. Best results based on tests of surface hardness, image adhesion, hydrophilicity, and aging characteristics are obtained at 10° C. However, decrease in performance from 10° C. to room temperature and even up to 40° C. is not very great. Operation at very low temperatures would require expensive cooling capacity. Accordingly, a temperature range between about 10° C. and 35° C. is preferred and an operating temperature of about 20° C. to about 25° C. is still further preferred because of operating economy and minimal loss of performance.

Over 60% of the metal oxide-organic complex film is produced within the first five seconds of electrodeposition. Times beyond five minutes are not beneficial for lithographic uses as no further film is produced but are not harmful as long as voltage is low as discussed above. A time range of between about 0.16 minutes and about 1 minute is preferred.

From a process point of view the short time, low temperature (room temperature with little need for auxiliary heating or cooling) and low current consumption are all favorable economic factors compared to conventional anodizing followed by thermal substrate treatments characteristic of prior art processes.

Light sensitive compositions suitable for preparation of printing forms by coating upon the metal oxide-organic complex films of this invention include iminoquinone diazides, o-quinone diazides, and condensation products of aromatic diazonium compounds together with appropriate binders. Such sensitizers are described in U.S. Pat. Nos. 3,175,906; 3,046,118; 2,063,631; 2,667,415; 3,867,147 with the compositions in the last being in general preferred. Further suitable are photopolymer systems based upon ethylenically unsaturated monomers with photoinitiators which may include matrix polymer binders. Also suitable are photodimerization systems such as polyvinyl cinnamates and those based upon diallyl phthalate prepolymers. Such systems are described in U.S. Pat. Nos. 3,497,356; 3,615,435; 3,926,643; 2,670,286; 3,376,138 and 3,376,139.

It is to be emphasized that the aforementioned specific light sensitive systems which may be employed in the present invention are conventional in the art. Although all compositions are useful, the diazos are generally preferred as they tend to adhere best to the metal oxide-organic complex and to exhibit higher resolution in printing.

The following non-limiting example serves to illustrate the invention.

EXAMPLE

Two sections of lithographic grade 3003 slurry brushed aluminum alloy are treated in a 1N solution of sodium hydroxide for 30 seconds and rinsed with distilled water at room temperature. The sections are respectively anodized in one of the following electrolyte solutions:

(1) A 1% by weight aqueous solution of polyvinyl phosphoric acid at a pH of 2.

(2) A 1% by weight aqueous solution of polyvinyl phosphoric acid titrated with concentrated ammonium hydroxide (29%) to a pH of approx. 6.5.

The anodizations are conducted with a counter lead electrode at 30 volts for 60 seconds with a maximum 5 amps/dm$^2$.

The thusly treated sections are whirler coated with the following photosensitive composition in a suitable solvent composition: 0.297 g $H_3PO_4$ (85%), 6.197 g polyvinyl acetal resin; 0.050 para-azo diphenylamine (exposure indicator); 3.166 g green dispersion; 3.166 g blue dispersion; 2.648 g of the polycondensation product of 3-methoxy-4-diazodiphenyl amine sulfate and 4.4' bis methoxy methyl diphenyl ether, precipitated as resitylene sulfonate. The dry coating weight is approximately 750 mg/m$^2$. The thusly prepared lithographic printing plates are exposed on a Berkey Ascor exposure device through a suitable photomask until a solid step 7 on a Stauffer exposure scale is attained. It is developed with Enco Negative Subtractive Developer and treated with Enco Subtractive Finisher, both available from American Hoechst Corporation, Somerville, NJ. Both sections are run on a Miehle printing press under breakdown conditions (using overpacked plate pressure and abrasive inks). The following printing conditions are used: uncoated paper stock, fountain solution having a pH of 4.35, relative humidity 53%, non-alcoholic dampening system.

Based on the density changes in the printed Stauffer exposure indicator, it is determined that the Section (2) sample wears 46% less than the Section (1) sample. A repetition of this test shows 38% wear improvement. The average of these two tests shows a 42% improvement in press performance comparing Section (2) sample to Section (1) sample. It is therefore concluded that the sections anodized at the higher pH give an improved press performance compared to the same prepared at the lower pH in the electrolytic solution.

What I claim is:

1. A process for preparing an element comprising cleaning a metal article, and then anodizing said metal article using direct current in an aqueous organic electrolytic solution having dissolved therein a water-soluble organic acid or mixture of two or more water-soluble organic acids which, if carboxylic be at least tribasic at a concentration of at least 0.05%, and a sufficient amount of a base to give said solution a pH in the range of from about 3 to about 10; under electrolytic conditions sufficient to form an insoluble metal oxide-organic complex, including said organic acid, bonded to the surface of said metal article.

2. The process of claim 1, wherein said water-soluble organic acid is elected from the group consisting of sulfonic, phosphonic, phosphoric, and tribasic or higher functionality carboxylic acids and mixtures of these.

3. The process of claim 2, wherein said water-soluble organic acid is selected from the group consisting of the condensation product of benzene phosphoric acid and formaldehyde, phytic acid, polyvinyl phosphonic acid, 2-ethyl polyphosphoric acid, and mixtures of these.

4. The process of claim 3, wherein the metal article is composed of aluminum or one of its alloys.

5. The process of claim 1, wherein said base is selected from the group consisting of sodium, lithium, potassium and ammonium hydroxide.

6. The process of claim 1, wherein the metal article is composed of steel or magnesium.

7. The process of claim 1, wherein said water-soluble organic acid is nitrilo triacetic acid.

8. The process of claim 1, wherein said water-soluble organic acid is 1,2,4,5 - benzene tetracarboxylic acid.

9. The process of claim 1, wherein said water-soluble organic acid is a condensation product of benzene phosphonic acid and formaldehyde.

10. The process of claim 1, wherein said water-soluble organic acid is a copolymer of methylvinyl ether and maleic anhydride.

11. The process of claim 1, wherein said water-soluble organic acid is polyvinyl sulfonic acid.

12. The process of claim 1, wherein said water-soluble organic acid is polystyrene sulfonic acid.

13. The process of claim 1, wherein said water-soluble organic acid is phytic acid.

14. The process of claim 1, wherein said water-soluble organic acid is alginic acid.

15. The process of claim 1, wherein said water-soluble organic acid is poly-n-butyl benzene sulfonic acid.

16. The process of claim 1, wherein said water-soluble organic acid is polydiisopropyl benzene sulfonic acid.

17. The process of claim 1, wherein said water-soluble organic acid is polyvinyl phosphonic acid.

18. The process of claim 1, wherein said water-soluble organic acid is dodecyl polyoxyethylene phosphoric acid.

19. The process of claim 1, wherein said water-soluble organic acid is dinonyl naphthalene disulfonic acid.

20. The process of claim 1, wherein said water-soluble organic acid is 2,2'-dinitro-4,4'-stilbene disulfonic acid.

21. The process of claim 1, wherein said water-soluble organic acid is diisopropyl polynaphthalene disulfonic acid.

22. The process of claim 1, wherein said water-soluble organic acid is 2-ethyl hexyl polyphoric acid.

23. The process of claim 1, wherein said water-soluble organic acid is dodecyl naphthalene disulfonic acid.

24. The process of claim 1, wherein said water-soluble organic acid is di-n-butyl naphthalene disulfonic acid.

25. The process of claim 1, wherein said water-soluble organic acid is polydecyl benzene sulfonic acid.

26. The process of claim 1, wherein said water-soluble organic acid is polyacrylic acid.

27. The process of claim 1, wherein said water-soluble organic acid is polymethacrylic acid.

28. The process of claim 1, wherein said water-soluble organic acid is diethylene diamine pentaacetic acid.

29. The process of claim 1, wherein said water-soluble organic acid is polynaphthalene sulfonic acid.

30. The process of claim 1, wherein said water-soluble organic acid is ethylenediamine tetraacetic acid.

31. The process of claim 1, wherein said water-soluble organic acid is hydroxyethyl ethylene diamine triacetic acid.

32. The process of claim 1, wherein said electrolyte solution has dissolved therein a mixture of two or more organic acids.

33. The process of claim 1, wherein said organic acid is present at a concentration of at least about 0.05%, said electrolysis is conducted at a voltage of between about 1.0 volts and about 90 volts, the maximum current density is about 10 amperes/$dm^2$, the electrolysis time is between about 0.08 minutes and about 5 minute, and the electrolyte temperature is from about −2° C. to about 60° C.

34. The process of claim 1, wherein and as an additional step, a light sensitive coating is applied to the surface of said insoluble metal oxide-organic complex.

35. The process of claim 34, wherein the light sensitive coating contains a sensitizer selected from the group consisting of o-quinone diazides, condensed aromatic diazonium compounds and photopolymers.

36. The product produced by the process of claim 1.

37. The product produced by the process of claim 4.

38. The product produced by the process of claim 34.

39. The product produced by the process of claim 35.

* * * * *

UNITED STATES PATENT AND TRADEMARK OFFICE

CERTIFICATE OF CORRECTION

PATENT NO. : 4,578,156

DATED : March 25, 1986

INVENTOR(S) : Stephan J. W. Platzer

It is certified that error appears in the above-identified patent and that said Letters Patent is hereby corrected as shown below:

On the title page, Item /75/ Inventor: "Plazter" should read — Platzer —.

Signed and Sealed this

*First* Day of *July 1986*

[SEAL]

*Attest:*

DONALD J. QUIGG

*Attesting Officer*

*Commissioner of Patents and Trademarks*